US007434381B2

(12) United States Patent
Vaubourg et al.

(10) Patent No.: US 7,434,381 B2
(45) Date of Patent: Oct. 14, 2008

(54) METHOD AND DEVICE FOR MANUFACTURING A WIRE CORD

(75) Inventors: Jean-Pierre Vaubourg, Hettange-Grande (FR); Marcel Van Puyenbroeck, Differdange (LU)

(73) Assignee: ArcelorMittal Bettembourg S.A., Bettembourg (LU)

( * ) Notice: Subject to any disclaimer, the term of this patent is extended or adjusted under 35 U.S.C. 154(b) by 153 days.

(21) Appl. No.: 10/576,700

(22) PCT Filed: Oct. 21, 2004

(86) PCT No.: PCT/EP2004/052609

§ 371 (c)(1),
(2), (4) Date: Apr. 20, 2006

(87) PCT Pub. No.: WO2005/040493

PCT Pub. Date: May 6, 2005

(65) Prior Publication Data

US 2007/0082561 A1 Apr. 12, 2007

(30) Foreign Application Priority Data

Oct. 22, 2003 (EP) ..... 03103896

(51) Int. Cl.
*D07B 1/00* (2006.01)

(52) U.S. Cl. ..... 57/311

(58) Field of Classification Search ..... 57/246, 57/311

See application file for complete search history.

(56) References Cited

U.S. PATENT DOCUMENTS

| | | | | |
|---|---|---|---|---|
| 3,413,792 | A | 12/1968 | Wardenberg | |
| 4,802,328 | A * | 2/1989 | Senyagin et al. | 57/9 |
| 5,111,649 | A | 5/1992 | Watakabe | |
| 5,581,990 | A * | 12/1996 | Van Giel et al. | 57/311 |
| 6,446,423 | B1 * | 9/2002 | Noferi | 57/58.52 |

FOREIGN PATENT DOCUMENTS

| | | |
|---|---|---|
| EP | 0676500 | 10/1995 |
| WO | WO 02/088459 | 11/2002 |

* cited by examiner

*Primary Examiner*—Shaun R Hurley
(74) *Attorney, Agent, or Firm*—McCormick, Paulding & Huber LLP

(57) ABSTRACT

A machine for manufacturing a cord consisting of twisted metallic wires comprises a pair of crimping wheels with meshing toothed surfaces for crimping a plurality of wires when they are passed between said meshing toothed surfaces, and a twisting means for twisting together the wires along a twisting path downstream of the pair of twisting wheels. The pair of crimping wheels is arranged at the beginning of the twisting path and the twisting together of the wires preferably starts between the meshing toothed surfaces.

12 Claims, 3 Drawing Sheets

METHOD AND DEVICE FOR MANUFACTURING A WIRE CORD

CROSS-REFERENCE TO RELATED APPLICATIONS

This application is entitled to the benefit of and incorporates by reference essential subject matter disclosed in International Application No. PCT/EP04/052609 filed on Oct. 21, 2004 and European Patent Application No. 03 103 896.1 filed on Oct. 22, 2003.

FIELD OF THE INVENTION

The present invention generally relates to a method and a machine for manufacturing a wire cord, in particular a high elongation wire cord used for reinforcing purposes and comprising crimped wires that are twisted together.

BACKGROUND OF THE INVENTION

Such a wire cord is commonly used for reinforcing elastomer products, such as tires. All or some of the individual wires are crimped before they are twisted together. The crimping of the wires results in a higher elongation at rupture of the cord and warrants a better elastomer penetration into the cord.

There are different prior art techniques for manufacturing high elongation cords that consists of crimped steel wires that are twisted together.

U.S. Pat. No. 5,707,467 discloses crimping the wires in a revolving cam-like pre-former before twisting them together. Such a cam-like pre-former comprises a plate-like or tubular rotary member with 3 to 4 staggered pins. The wire is guided in a zigzag path along the staggered pins and the pre-former is rotated along the wire axis, whereby the pre-former pre-forms a helical wavy form in the wire. Each wire is pre-formed in a separate pre-former. The crimped wires are introduced through a die and a hollow shaft into a rotating buncher type twister, inside which they are twisted together into a cord that is wound on a take-up bobbin. This method has major drawbacks. The zigzag path of the wire in the revolving pre-former requires a limitation of the pulling speed of the wire, and this results of course in a lower productivity. The pre-formers must all be driven in rotation at a controlled speed, which is difficult to achieve. Last but not least, the crimped wires are smoothened again when they are guided over guide rolls and through guide dies before being twisted together.

U.S. Pat. No. 5,111,649 discloses crimping the wires between the meshing teeth of a pair of gear-like wheels. Downstream of the gear-like wheels the crimped wires pass through through-holes in a stationary plate before they are introduced into a twisting machine that twists them together into a steel cord. This method has major drawbacks, too. The toothed wheels can only provide a relatively flat deformation of the wires without risking to damage them. Furthermore, the stationary plate guiding the crimped wires into the twisting machine has a tendency to smooth them again.

Also U.S. Pat. No. 6,311,466 discloses crimping the wires between toothed wheels. However, instead of using only one pair of toothed wheels, one suggests to use a second pair of toothed wheels that is placed next to the first pair in order to pre-form the wire in a plane turned by 90 degrees compared to the first crimping plane and with a different pitch than the first pair. Each wire passes through a separate toothed wheels arrangement. Thereafter, the crimped wires are bundled and introduced into a known twisting machine to be twisted together. According to U.S. Pat. No. 6,311,466, the individual steel wires should thus receive a spatial deformation before they are twisted together, which is said to improve rubber penetration, to increase elongation at rupture and to decrease the stiffness of the cord. It will, however, be appreciated that the wire has a tendency to tilt when it leaves the first pair of toothed wheels. Thus, the second pair of toothed wheels tends to generate the second wave in the same plane as the first wave, which partially ruins the expected advantages. Moreover, this method also suffers from a smoothing back of the crimped wires prior to the final twisting operation.

WO 02/088459 discloses a method for manufacturing a wire cord comprising the steps of bundling a plurality of wires in a bundling means; crimping the wires between meshing toothed surfaces; and twisting together the plurality of crimped wires along a twisting path.

OBJECT AND SUMMARY OF THE INVENTION

The object of the present invention is to provide a method and a machine for more efficiently manufacturing a wire cord comprising crimped metallic wires that are twisted together.

In accordance with an important aspect of the present invention, the crimping is carried out by passing a plurality of wires between meshing toothed surfaces that are located at the beginning of the twisting path, along which the wires are twisted together. This feature allows to obtain excellent results with regard to the elongation at rupture of the cord and elastomer penetration into the cord. There is no smoothing of the crimped wires before they are twisted together and there is a very homogeneous distribution of the crimping waves in the twisted cord. Furthermore, the method in accordance with the present invention can be carried out with very simple crimping equipment, it does not need complicated adjustments and it allows to obtain very good productivity results.

The plurality of wires shall be closely bundled so that they lie closely side-by-side in one plane before they are crimped between the meshing toothed surfaces, and the twisting together of the wires shall preferably already start between the meshing toothed surfaces of the crimping wheels. The plurality of wires shall still lie closely side-by-side in one plane at the entrance of the meshing toothed surfaces of the crimping wheels, whereas at the outlet of the meshing toothed surfaces, the wires shall already be crossing one another.

A machine for manufacturing a cord in accordance with the present invention has a crimping means with crimping wheels with meshing toothed surfaces for crimping the wires and a twisting means for twisting together the wires along a twisting path. In accordance with an important aspect of the present invention, the crimping means comprises a pair of crimping wheels with meshing toothed surfaces that is located at the beginning of the twisting path, and the machine also comprises bundling means located upstream of the pair of crimping wheels for closely bundling a plurality of wires in such a way as to force the plurality of wires to lie closely side-by-side before passing them between said toothed surfaces at the beginning of said twisting path.

The bundling means is preferably a bundling die with an aperture that is dimensioned in such a way as to force the plurality of wires to lie closely side by side. Good results are achieved if the bundling means is located between 30 mm to 60 mm from the point where the wires enter between the meshing toothed surfaces.

Within a toothed surface, two successive teeth with a tooth thickness t are separated by a gap with a gap width g, wherein the tooth thickness t and the gap width g shall preferably satisfy following relation: $2t<g<4t$. Furthermore, if the wires have a diameter D, the tooth thickness t and the diameter D should satisfy following relation: 2D<t<4D, wherein the wires normally have a diameter D between 0.2 mm and 1.0 mm and most often between 0.2 mm and 0.5 mm.

Advantageously, the distance between the crimping wheels is finely adjustable, so that the penetration of the teeth of one wheel into the gaps of the other wheel is adjustable. This allows to adjust the crimp amplitude, whereby it is possible to optimize mechanical properties of the cord and/or rubber penetration into the cord.

In a preferred embodiment, the twisting means comprises a rotor that can be rotated about a rotor rotation axis and a deflection pulley supported on the rotor. The deflection pulley forms the end of the twisting path, which is substantially co-axial to the rotor rotation axis.

The invention may be carried out on a great variety of steel cord twisting machines. However, because of the small space required for crimping the wires, it is e.g. particularly suited for twisting machines in which the wire unwinding devices for the wires are supported on a central cradle. Such a machine comprises e.g. a support structure, a rotor with a first rotor end and a second rotor end, which is supported by the support structure in such a way as to be capable of rotating about a rotor rotation axis, a cradle supported between the first rotor end and the second rotor end, in such a way as to be capable of freely rocking about the rotor rotation axis, whereby the cradle remains immobile in rotation when the rotor is rotated. The cradle supports a plurality of wire unwinding devices. The pair of crimping wheels is mounted on the cradle in such a way as to be substantially aligned with the rotor rotation axis. Guiding means are provided on the cradle for guiding a plurality of wires from the unwinding devices towards the pair of crimping wheels. A first deflection pulley is supported on the first rotor end, in such a way as to be capable of twisting together the wires in the twisting path, which extends from the first deflection pulley to the pair of crimping wheels. A first flyer arm is connected to the first rotor end and a second flyer arm is connected to the second rotor end, wherein the first and second flyer arms are capable of guiding the twisted wires about the cradle from the first rotor end to the second rotor end. A second deflection pulley is supported on the second rotor end, in such a way as to be capable of guiding the twisted wires coming from the second flyer arm axially out of the second rotor end, where a pulling means is used for pulling the twisted wires out of the second rotor end.

BRIEF DESCRIPTION OF THE DRAWINGS

The present invention will now be described, by way of example, with reference to the accompanying drawing, in which.

DETAILED DESCRIPTION OF A PREFERRED EMBODIMENT

Figure 1:
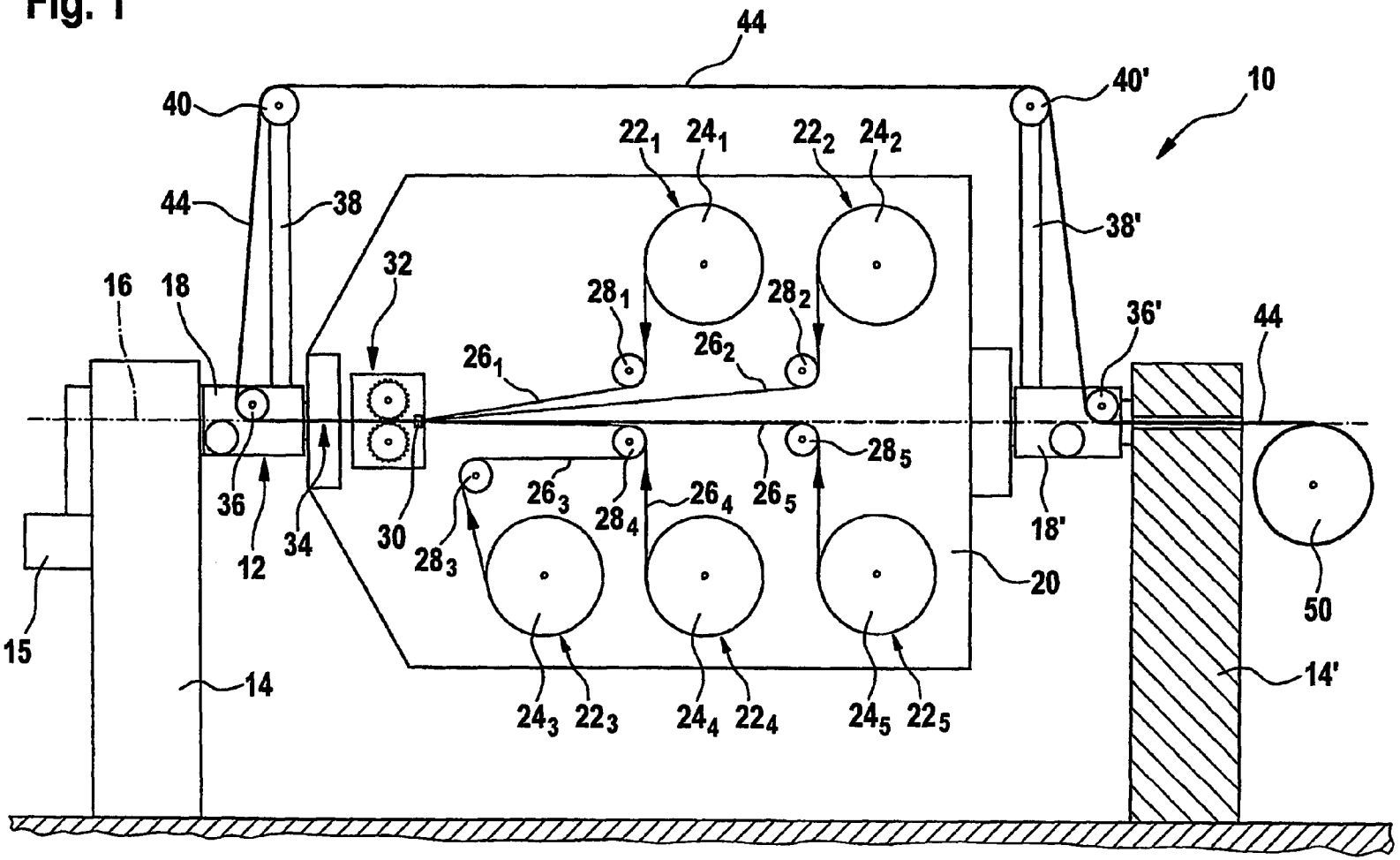
FIG. 1 is a schematic general view of a machine for manufacturing a cord comprising a plurality of crimped wires.

FIG. 1 shows a machine 10 for manufacturing a cord consisting of five steel wires that are crimped and twisted together. The machine comprises, in a configuration known per se, a rotor 12 that is supported by a support structure 14, 14' in such a way as to be capable of being rotated by a motor 15 about a rotor rotation axis 16. The rotor comprises a first rotor end 18 and a second rotor end 18'. A cradle 20 is mounted between both rotor ends 18, 18', in such a way as to be capable of freely rocking about the rotor rotation axis 16, whereby the cradle 20 remains immobile in rotation when the rotor 12 is rotated about the rotor rotation axis 16.

The cradle 20 supports five conventional unwinding devices $\mathbf{22}_1$, $\mathbf{22}_2$, $\mathbf{22}_3$, $\mathbf{22}_4$, $\mathbf{22}_5$. Each of these unwinding devices receives one wire spool $\mathbf{24}_1$, $\mathbf{24}_2$, $\mathbf{24}_3$, $\mathbf{24}_4$, $\mathbf{24}_5$, delivering one of the five steel wires $\mathbf{26}_1$, $\mathbf{26}_2$, $\mathbf{26}_3$, $\mathbf{26}_4$, $\mathbf{26}_5$ which will form the final cord. Five guiding pulleys $\mathbf{28}_1$, $\mathbf{28}_2$, $\mathbf{28}_3$, $\mathbf{28}_4$, $\mathbf{28}_5$ guide the five wires $\mathbf{26}_1$, $\mathbf{26}_2$, $\mathbf{26}_3$, $\mathbf{26}_4$, $\mathbf{26}_5$, which are unwound from the five wire spools $\mathbf{24}_1$, $\mathbf{24}_2$, $\mathbf{24}_3$, $\mathbf{24}_4$, $\mathbf{24}_5$, into a bundling die 30 that is substantially co-axial to the rotor rotation axis 16. From the bundling die 30, the wires $\mathbf{26}_1$, $\mathbf{26}_2$, $\mathbf{26}_3$, $\mathbf{26}_4$, $\mathbf{26}_5$, pass through a crimping device 32, which is fixed on the cradle 20 and consequently immobile in rotation about the rotor rotation axis 16, onto the first rotor end 18, which is in rotation about the rotor rotation axis 16. The crimping device 32 and the crimping operation itself will be described later. At the outlet of the crimping device 32 the wires follow a path 34 that is substantially co-axial with the rotor rotation axis 16. This path 34 will be called hereafter "twisting path", because the individual wires $\mathbf{26}_1$, $\mathbf{26}_2$, $\mathbf{26}_3$, $\mathbf{26}_4$, $\mathbf{26}_5$, are twisted together along this path 34, as will now be explained.

The first rotor end 18 forms a first twisting device and comprises, in a configuration known per se, a deflection pulley 36 (which is also called twisting pulley 36), a flyer arm 38 and a flyer arm deflection pulley 40. The twisting pulley 36 is directly supported on the rotor 12. The flyer arm 38 extends radially from the first rotor end 18 and supports the flyer arm pulley 40 at its free end. The second rotor end 18' comprises, in the same way, a deflection pulley 36', a flyer arm 38' and a flyer arm deflection pulley 40'.

When the rotor 12 is rotated by the motor 15, the cradle 20 remains immobile, so that the twisting pulley 36 twists together the wires $\mathbf{26}_1$, $\mathbf{26}_2$, $\mathbf{26}_3$, $\mathbf{26}_4$, $\mathbf{26}_5$ within the twisting path 34. Thus, a twisted wire cord 44 is formed. The twisting pulley 36 guides this cord 44 onto the flyer arm deflection pulley 40 of the flyer arm 38. From the flyer arm deflection pulley 40, the cord 44 passes onto the flyer arm deflection pulley 40' of the flyer arm 38', whereby the cord 44 is guided about the cradle 20 from the first rotor end 18 onto the second rotor end 18'. From the flyer arm deflection pulley 40', the cord 44 passes into the second rotor end 18'. The deflection pulley 36' in this second rotor end 18' guides the cord 44 within the axis of rotation 16 out of the second rotor end 18', where the cord 44 is pulled away by a conventional winding device 50 (here schematically represented by a spool). Downstream of the deflection pulley 36', the cord 44 is subjected to a second twist, which completes its formation.

The crimping device 32 will now be described with reference to FIG. 2. It comprises a pair of crimping wheels 51, 51' with meshing toothed surfaces 52, 52'. The crimping wheels 51, 51' are auto-rotating when the wires 26.sub.i are pulled through between the meshing toothed surfaces 52, 52'. These toothed surfaces 52, 52' have a particular design. Indeed, two successive teeth with a tooth thickness t are separated by a gap with a gap width g that is much larger than the tooth thickness t. The gap width g shall normally satisfy the following condition: 2t<g<4t. The tooth thickness shall be fixed in function of the wire diameter D and shall normally satisfy following condition: 2D<t<4D. For a wire diameter D of 0.38 mm a tooth thickness t of 1 mm and a gap width g of 3 mm were retained. The teeth shall have a rounded profile in order not to damage the wires. The distance between the two crimping wheels 51, 51' shall be finely adjustable, so that the penetration of the teeth of one wheel into the gaps of the other wheel can be adjusted. This can e.g. be achieved by mounting one of the crimping wheels 51, 51' on a conventional micrometer adjustment device (not shown).

Figure 2:
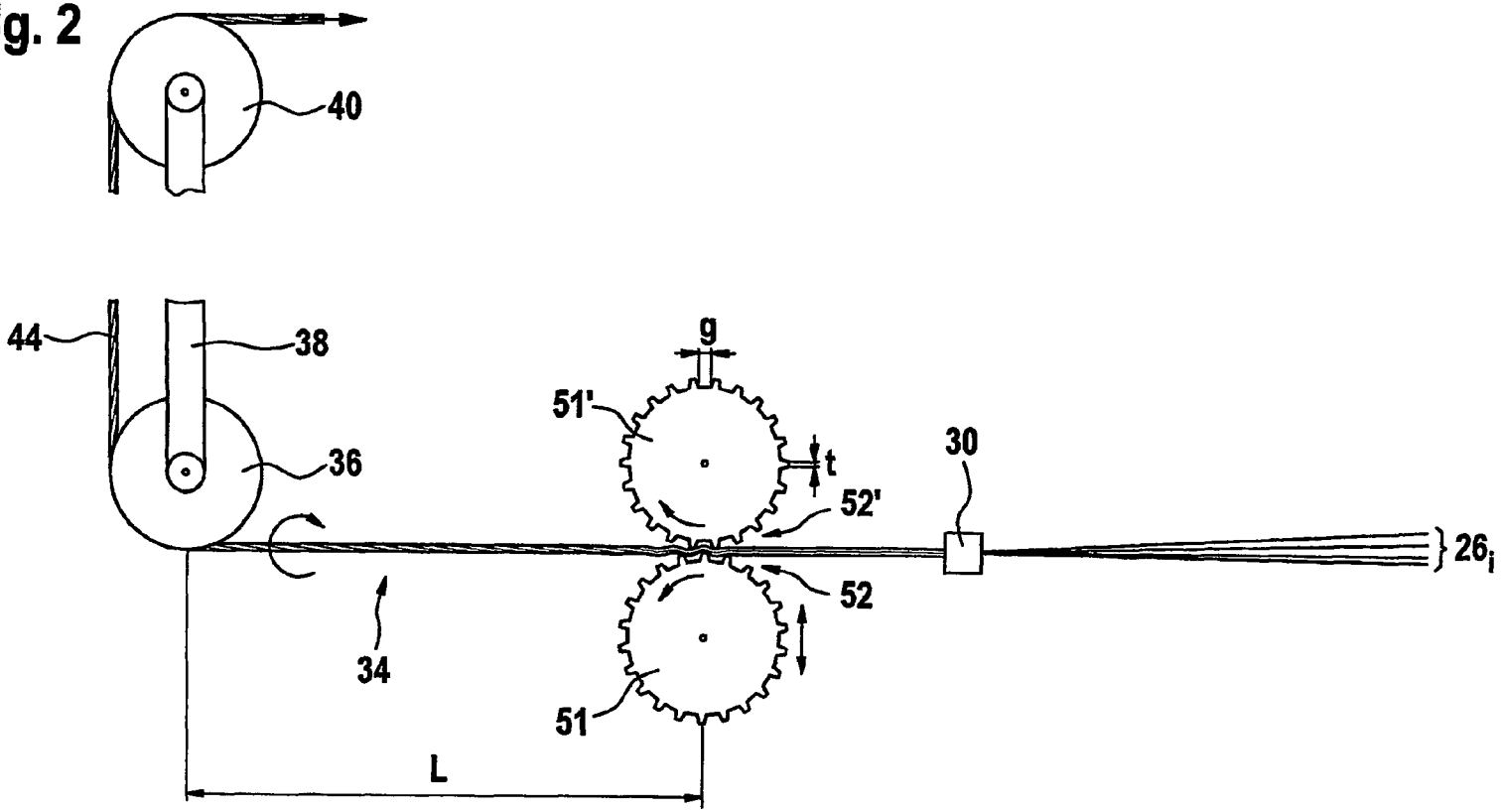
FIG. 2 is a schematic view illustrating the bundling of the wires, the crimping of the wires between meshing toothed surfaces of a pair of crimping wheels and the twisting together of the wires.
Figure 4:
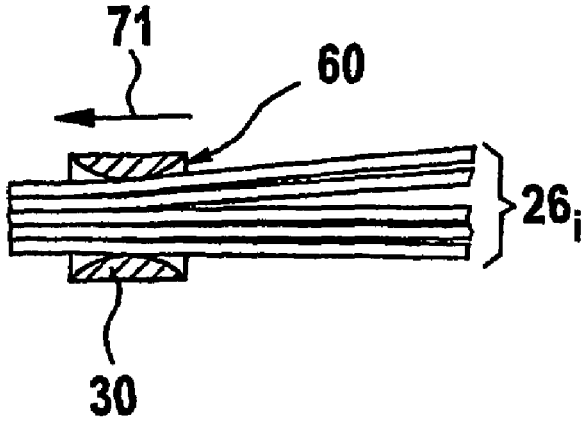
FIG. 4 is an enlarged section through a bundling die with wires passing through it.

On FIG. 2 one can also see the bundling die 30 arranged upstream of the crimping wheels 51, 51'. The object of this bundling die 30 is to closely bundle the wires $\mathbf{26}_i$ before they are crimped between the meshing toothed surfaces 52, 52'. In order to be fully effective, the bundling die 30 shall be located between 30 mm to 60 mm from the point where the wires $\mathbf{26}_i$ enter between the meshing toothed surfaces. FIG. 4 shows a section through the bundling die 30. It can be seen that the bundling die 30 has an aperture 60 for the wires $\mathbf{26}_i$ that is dimensioned in such a way as to force the five wires $\mathbf{26}_i$ to lie closely side by side.

FIG. 2 also shows a schematic representation of the twisting means with the twisting pulley 36, the flyer arm 38 and the flyer arm deflection pulley 40. Good results have been obtained with a distance L between the crimping wheels 51, 51' and the twisting pulley 36 in the range of 100 mm to 150 mm.

Figure 3:
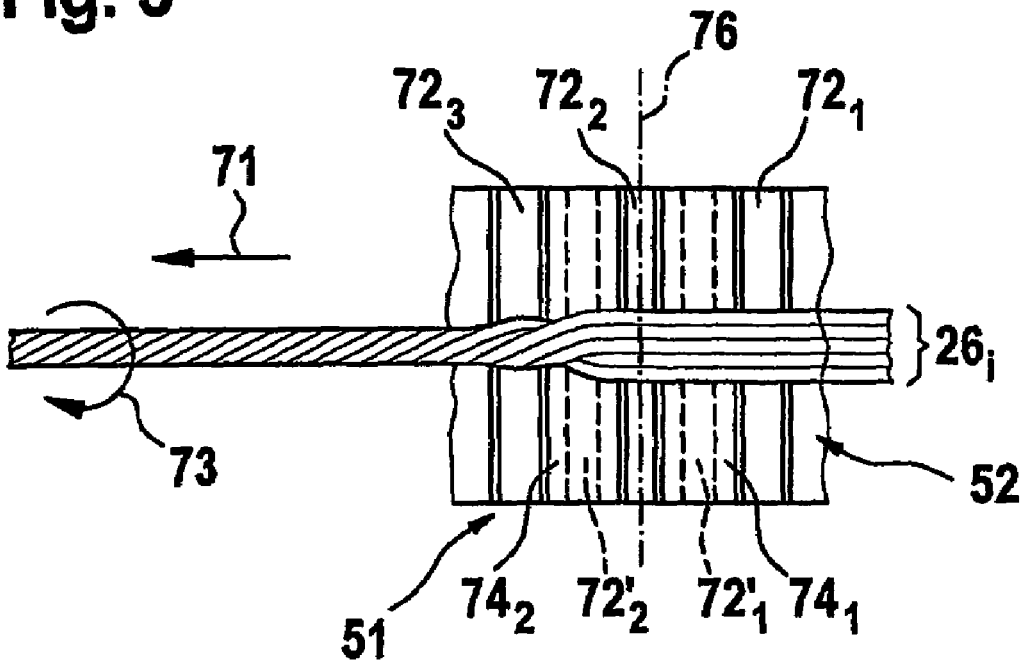
FIG. 3 is a top view showing an enlarged detail of the toothed surface of a crimping wheel with wires thereon.

An important aspect of the present invention will now be described with reference to FIG. 3, which schematically shows, as an enlarged detail, a top view on the toothed surface 52 of the crimping wheel 51, which is meshing with the toothed surface 52' of the crimping wheel 51' for crimping the wires $\mathbf{26}_i$. Arrow 71 identifies the travelling direction of the wires $\mathbf{26}_i$, which is parallel to the plane of the FIG. 3, and arrow 73 identifies the twisting sense. The dashed line 76 represents the axis of rotation of the crimping wheel 51. Reference numbers $\mathbf{72}_1$, $\mathbf{72}_2$, $\mathbf{72}_3$ identify three teeth of the toothed surface 52, which are separated by the gaps $\mathbf{74}_1$ and $\mathbf{74}_2$. Two teeth $\mathbf{72'}_1$, $\mathbf{72'}_2$ of the meshing toothed surface 52' of crimping wheel 51' are represented with doted lines as they penetrate into the gaps $\mathbf{74}_1$ and $\mathbf{74}_2$ of the toothed surface 52. The three teeth $\mathbf{72}_1$, $\mathbf{72}_2$, $\mathbf{72}_3$ of the toothed surface 52 and the two teeth $\mathbf{72'}_1$, $\mathbf{72'}_2$ of the meshing toothed surface 52' cooperate to crimp the wires $\mathbf{26}_i$. In accordance with an important aspect of the present invention this crimping takes place at the beginning of the twisting path 34. In FIG. 3 it can be seen that at the entrance of the meshing toothed surfaces 52, 52', the five wires $\mathbf{26}_i$ lie closely side by side in one plane, whereas at the outlet of the meshing toothed surfaces 52, 52' the wires $\mathbf{26}_i$ are already crossing one another, i.e. the twisting together of the wires $\mathbf{26}_i$ starts between the meshing toothed surfaces 52, 52'.

It will be appreciated that locating the crimping of the wires at the beginning of the twisting together of the wires, allows to obtain excellent results with regard to the elongation at rupture of the cord and the elastomer penetration into the cord. Thus it has e.g. been possible to make a 5×0.38 HT HE steel cord with an elongation at rupture of more than 5%. There is no smoothing of the crimped wires before they are twisted together and there is a very homogeneous distribution of the crimping waves in the twisted cord. Furthermore, the method in accordance with the present invention can be carried out with very simple crimping equipment, it does not need complicated adjustments and allows to obtain very good productivity results.

The invention claimed is:

1. A method for manufacturing a wire cord, said method comprising the steps of:

bundling a plurality of wires in a bundling means in such a way to form a bundle of wires wherein said wires lie closely side-by-side in one plane;

crimping said wires by passing said bundle of wires between meshing toothed surfaces; and twisting together said plurality of crimped wires along a twisting path, wherein said meshing toothed surfaces are located at the beginning of said twisting path, and wherein said twisting together starts between said meshing toothed surfaces.

2. The method according to claim 1, wherein:

at the entrance of said meshing toothed surfaces, said wires still lie closely side-by-side in one plane; and at the outlet of said meshing toothed surfaces, said wires are crossing one another.

3. A machine for manufacturing a wire cord, said machine comprising:

a bundling means for bundling a plurality of wires, wherein said bundling means is configured in such a way as to force said plurality of wires to form a bundle of wires wherein said wires lie closely side-by-side in one plane;

a crimping means located downstream of said bundling means, said crimping means comprising crimping wheels with meshing toothed surfaces for crimping said wires; and a twisting means for twisting together said wires along a twisting path, wherein said crimping means is located at the beginning of said twisting path, and wherein said twisting together starts between said meshing toothed surfaces.

4. The machine according to claim 3, wherein said bundling means is located between 30 mm to 60 mm from the point where said bundle of wires enters between said meshing toothed surfaces.

5. The machine according to claim 3, wherein said bundling means is a bundling die with an aperture, said aperture being dimensioned in such a way as to force said plurality of wires to lie closely side-by-side in one plane.

6. The machine according to claim 5, wherein said bundling die is located between 30 mm to 60 mm from the point where said bundle of wires enters between said meshing toothed surfaces.

7. The machine according to claim 3, wherein in said meshing toothed surfaces two successive teeth with a tooth thickness t are separated by a gap with a gap width g, and said tooth thickness t and said gap width g satisfy following relation: 2t<g<4t.

8. The machine according to claim 7, wherein said wires have a diameter D and said tooth thickness t and said diameter D satisfy following relation:

$$2D<t<4D.$$

9. The machine according to claim 8, wherein said wires have a diameter D between 0.2 and 0.1 mm.

10. The machine according to claim 3, wherein said crimping means comprises a pair of crimping wheels with meshing toothed surfaces for crimping said wires, the distance between said crimping wheels in said pair being finely adjustable, so that the penetration of the teeth of one wheel into the gaps of the other wheel is adjustable.

11. The machine according to claim 3, wherein said twisting means comprises:

a rotor that can be rotated about a rotor rotation axis; and a deflection pulley supported on said rotor, said deflection pulley forming the end of said twisting path, wherein the latter is substantially co-axial to said rotor rotation axis.

12. A machine for manufacturing a wire cord, said machine comprising:

a support structure;

a rotor with a first rotor end and a second rotor end, said rotor being supported by said support structure in such a way as to be capable of rotating about a rotor rotation axis;

a cradle supported between said first rotor end and said second rotor end, in such a way as to be capable of freely rocking about said rotor rotation axis, whereby said cradle remains immobile in rotation when said rotor is rotated;

a plurality of wire unwinding devices supported by said cradle;

guiding means mounted on said cradle for guiding a plurality of wires from said unwinding devices towards said rotor rotation axis;

a bundling means mounted on said cradle for bundling said plurality of wires from said unwinding devices, wherein said bundling means is configured in such a way as to force said plurality of wires to form a bundle of wires wherein said wires lie closely side-by-side in one plane substantially within said rotor rotation axis;

a crimping means mounted on said cradle downstream of said bundling means, said crimping means comprising crimping wheels with meshing toothed surfaces for crimping said wires substantially within said rotor rotational axis;

a twisting means for twisting together said wires along a twisting path, wherein said crimping means is located at the beginning of said twisting path, said twisting means comprising a first deflection pulley supported on said first end of said rotor, in such a way as to be capable of twisting together said plurality of wires in said twisting path, which extends from said first deflection pulley to said pair of crimping wheels;

first flyer arm connected to said first rotor end an a second flyer arm connected to said second rotor end, said first and second flyer arm being capable of guiding the twisted wires about said cradle from said first rotor end to said second rotor end;

a second deflection pulley supported on said second end of said rotor, in such a way as to be capable of guiding said twisted wires coming from said second flyer arm axially out of said second rotor end; and a pulling means for pulling said twisted wires out of said second rotor end.

* * * * *